US009445673B2

(12) United States Patent
Wolfe

(10) Patent No.: US 9,445,673 B2
(45) Date of Patent: Sep. 20, 2016

(54) CHILDS MODIFIED TRUCK SLEEPING BED

(71) Applicant: James Edward Wolfe, Greenville, SC (US)

(72) Inventor: James Edward Wolfe, Greenville, SC (US)

( * ) Notice: Subject to any disclaimer, the term of this patent is extended or adjusted under 35 U.S.C. 154(b) by 0 days.

(21) Appl. No.: 13/950,183

(22) Filed: Jul. 24, 2013

(65) Prior Publication Data

US 2015/0026883 A1 Jan. 29, 2015

(51) Int. Cl.

| | |
|---|---|
| ***A47D 7/00*** | (2006.01) |
| ***A47D 7/01*** | (2006.01) |
| ***A47C 19/20*** | (2006.01) |
| ***A47C 19/22*** | (2006.01) |

(52) U.S. Cl.

CPC ..... *A47D 7/00* (2013.01); *A47C 19/20* (2013.01); *A47C 19/22* (2013.01); *A47D 7/01* (2013.01)

(58) Field of Classification Search

CPC .. A47C 19/005; A47C 19/02; A47C 19/021; A47C 19/022; A47C 19/025; A47C 19/20; A47C 19/22; A47C 17/64; A47C 17/645; A47C 17/68; A47C 17/70; A47C 17/72; A47C 19/00; A47C 19/024; A47C 19/04; A47D 7/00; A47D 7/007; A47D 7/01; A47D 7/02; A47D 7/03; A47D 11/00; A47D 11/005

USPC ..... 5/279, 280, 285, 2.1, 907, 200.1, 201, 5/310, 114, 112; D6/382–384, 388, 390

See application file for complete search history.

(56) References Cited

U.S. PATENT DOCUMENTS

| | | | | | |
|---|---|---|---|---|---|
| D147,943 | S | * | 11/1947 | Ziegler | D6/388 |
| D163,949 | S | * | 7/1951 | Harris | D6/388 |
| D167,632 | S | * | 9/1952 | Jackson | D6/384 |
| D175,742 | S | * | 10/1955 | Ruiz et al. | D6/388 |
| D189,741 | S | * | 2/1961 | Gatov | D6/388 |
| D196,485 | S | * | 10/1963 | Santine | D6/384 |
| 3,105,976 | A | * | 10/1963 | Roche | F16B 12/52 108/156 |
| D203,656 | S | * | 2/1966 | Santine | D6/388 |
| D218,512 | S | * | 8/1970 | Wyatt et al. | D6/388 |
| 3,965,502 | A | * | 6/1976 | Bertram | A47C 17/645 5/111 |
| 3,995,334 | A | * | 12/1976 | Harris | A47C 19/005 5/181 |
| D253,259 | S | * | 10/1979 | Rutar | D6/388 |
| D264,773 | S | * | 6/1982 | Sutherland | D6/388 |
| 4,364,134 | A | * | 12/1982 | Marks | A47C 19/021 5/200.1 |
| D275,912 | S | * | 10/1984 | Hydrusko et al. | D6/388 |
| 4,627,120 | A | * | 12/1986 | Harris | A47C 19/024 5/201 |
| D292,758 | S | * | 11/1987 | Bethune | D6/388 |
| D292,952 | S | * | 12/1987 | Mercurio | D6/388 |
| D294,893 | S | * | 3/1988 | Mowery et al. | D6/388 |
| 4,873,733 | A | * | 10/1989 | Wang | 5/98.1 |
| 4,888,837 | A | * | 12/1989 | Wang | 5/93.1 |
| D313,322 | S | * | 1/1991 | Ventulett | D6/388 |

(Continued)

*Primary Examiner* — Robert G Santos

(57) ABSTRACT

A bed assembly for providing a place of entertainment and a place to sleep for people of all ages, primarily children. The bed assembly is functional, ornamental, and entertaining. The assembly provides for a frame, body, and wheels. The interior frame and under-carriage assembly is a structure of vertical, horizontal, angled, and transverse support members elevated by columns and truss oriented support members that may be assembled by the consumer. The body of the bed is primarily for ornamental design and is to give shape and dimension to the frame by using a plurality of detachable body panels. A tire/wheel assembly consists of a rim/wheel to provide for ornamental design, seating, and entertainment by the consumer, as it attaches and detaches as part of its function. The assembly includes two locations for storing mattresses for use in sleeping, an upper and lower location.

12 Claims, 6 Drawing Sheets

(56) References Cited

U.S. PATENT DOCUMENTS

| | | | | | |
|---|---|---|---|---|---|
| 5,044,024 | A | * | 9/1991 | Del Rose | 5/400 |
| D324,461 | S | * | 3/1992 | Soulard | D6/388 |
| 5,184,360 | A | * | 2/1993 | Gonzalez | 5/2.1 |
| D347,125 | S | * | 5/1994 | Brunel | D6/388 |
| D390,035 | S | * | 2/1998 | Suarez | D6/390 |
| D400,370 | S | * | 11/1998 | Stice | D6/388 |
| D404,215 | S | * | 1/1999 | Hohl | D6/388 |
| D407,862 | S | * | 4/1999 | Gasiorek | D30/118 |
| 5,950,257 | A | * | 9/1999 | Smith et al. | 5/2.1 |
| D414,621 | S | * | 10/1999 | Boston et al. | D6/388 |
| D488,316 | S | * | 4/2004 | Libardi | D6/388 |
| 6,938,288 | B2 | * | 9/2005 | Hunter | A47C 17/645 5/110 |
| D550,475 | S | * | 9/2007 | Chevrier et al. | D6/388 |
| D627,984 | S | * | 11/2010 | Haugland | D6/388 |
| D653,472 | S | * | 2/2012 | Haugland | D6/388 |
| 8,464,371 | B1 | * | 6/2013 | Martin | A61G 7/1019 5/175 |
| 8,677,525 | B1 | * | 3/2014 | Martin | A61G 7/1019 5/175 |
| 2005/0011002 | A1 | * | 1/2005 | Hunter | A47C 17/645 5/9.1 |

* cited by examiner

CHILDS MODIFIED TRUCK SLEEPING BED

FIELD OF THE INVENTION

The present invention relates to the field of beds or bed frames as well as to the field of miniature vehicles and seating. More particularly, the present invention relates to the combination of both beds and miniature vehicles that provides a place for up to two people to sleep. Even more particularly, the invention relates to an assembly that is both a place of entertainment for those who enjoy modified trucks with extremely large wheels in competitive shows (more commonly known as "monster truck racing") as well as a providing a place to sleep and sit.

BACKGROUND OF THE INVENTION

Beds and bunk beds are known in the prior art. Such beds are known to consist of standard shapes and configurations that are expected and obvious fulfilling numerous design alternatives and choices for varying consumer preferences.

Known prior art includes:

| U.S. Patent Documents | | |
|---|---|---|
| D167632 | September 1952 | Jackson |
| D189741 | February 1961 | Gatov |
| D218512 | August 1970 | Wyatt et al. |
| D249403 | September 1978 | Lamb |
| D286232 | October 1986 | Fisher |
| D294893 | March 1988 | Mowery et al. |
| D677072 | March 2013 | Pegza et al. |
| 3188661 | June 1965 | Rudy |
| 3638246 | February 1972 | Jewell |
| 4312086 | January 1982 | Bianco |
| 6223363 | May 2001 | Sumlin |
| 6721969 | April 2004 | Lupo et al. |

Such prior art fulfills the needs of their particular devices, but do not disclose an ornamental bed assembly that is both a place of entertainment for those who enjoy modified trucks with extremely large wheels in competitive shows (more commonly known as "monster truck racing") as well as a providing a place to sleep and sit.

This inventive device includes a bed assembly for providing a place of entertainment and a place to sleep and sit for people of all ages. The assembly provides for a frame, body, and wheels. The interior frame assembly is composed of a structure assembled in a vertical, horizontal, angled, and transverse pattern of support members elevated by columns. Truss oriented support members help elevate the upper assembly. The body of the bed assembly represents a miniature version of a pick-up truck (or other body style) and is primarily for ornamental design. The body is designed to give shape and dimension to the frame. The body is attached to the interior frame. A tire/wheel assembly that attaches and detaches, even after full bed assembly, consists of a rim/wheel to provide for separate seating, aesthetics, and entertainment. The invention provides two proposed locations for storing mattresses making it useable as a bunk bed, or single bed.

SUMMARY OF THE INVENTION

An object of the present invention is to provide for entertainment for those who enjoy modified truck racing (more commonly known as "monster truck fans").

A further object of the present invention is to provide a place for people of all ages to sleep on a mattress.

A further object of the present invention is to provide an object of discussion and pride especially for those who desire to purchase up-sale or optional items for their bed assemblies that show distinctive paraphernalia designed to show brand loyalty.

A further object of the present invention is to provide an assembly that can be disassembled, and modified with the use of optional purchase bodies to change the body style and ornamental design of the bed assembly.

A further object of the present invention is to provide for a bed assembly that is easily manufactured and marketed to the public.

A further object of the present invention is to provide a bed assembly that is durable for use in a dual purpose, that being entertainment (visually and physically) as well as providing a place to sleep.

An additional object of the present invention is to provide for an artistic appeal (ornamental attraction) to generally children, but also "monster truck fans," whereby instead of having a bed in a bedroom, an individual can instead utilize this invention and decorate one's bedroom as a "garage" with this invention that visually imitates a miniature monster truck, with large wheels. Complementary "garage" style furniture is known in the prior art and currently available for sale to the public.

An additional object of the present invention is to provide an alternative of sleep locations. The bed frame, when fully assembled provides locations for two (2) mattresses, but only one mattress is necessary to utilize the invention as a bed.

An additional object of the present invention is to provide for a means to change the sheets on both mattresses without difficulty. This is provided by easy access to the bottom mattress from every side. The top mattress can be accessed from both sides and rear. The front side of the upper mattress can be accessed via the hood which is moveable.

An additional object of the present invention is to provide a place for seating, as the tires or rim/wheel assembly are removable and can be used for seating.

These objects, as well as others, will become apparent from the following detailed descriptions and associated drawings of the embodiment.

The bed assembly is comprised of three primary items, with optional additions:

1) Frame assembly made of structural members in a vertical, horizontal, angled, and transverse directions. Frame assembly has optional and additional support members to structurally support varying body styles as mentioned in 2) below.
2) Body assembly made of body panels imitating those on monster trucks. Body assembly can come in multiple designs such as pick-up truck, SUV, sedan, hatchback, sports car, and other conventional and non-conventional designs.
3) Wheel and rim combination that is made to represent the large tires that are commonly used on monster trucks. Wheels can be of a differing variety, such as branded with logos, or with differing tread patterns and blocks based on consumer choice, and body assembly styling.
4) Optional items include up-sale accessories for ornamental design and entertainment purposes include, but are not limited to shocks, grills, lights, dashboard features, other automotive and garage elements or features, such as jack-stands, as well as stickers and logos to represent and give the appearance of branding to discerning loyal consumers.

The purpose of said present invention is to provide a new bed assembly which has many advantages compared to prior art. The features hereby disclosed show features and designs not yet anticipated, not rendered obvious, not suggested, nor implied by prior art beds or bunk beds.

As such, those knowledgeable about prior art will realize that this invention hereby disclosed may and will be used in future designs of similar bed assemblies for similar purposes. It is therefore critical that the claims listed herein are regarded as including such similar and equivalent design and constructions so much as they do not depart from the scope and spirit of the present invention hereby disclosed.

It is therefore the intent of this bed assembly to not simply improve upon that which already exists in the prior art, but to provide an improved and advantageous assembly constructed in no similar manner to conventional or unconventional beds, but to also provide for the inclusion of entertainment, visually and physically, through its yet to be anticipated features, that are not obvious, suggested, nor implied in prior art, either alone in application, or in any combination of aforementioned art.

Although the description above contains specificities concerning the construction, manufacture, and design of the invention, these should not be construed as limiting the scope of the present invention, but as merely identifying and providing some of the presently recognized embodiments of the invention. Thus, the scope of said present invention should be determined to include multiple body styles and other "up-sale" optional features as noted, but limited to the following:

1) Shocks which can be added to vertical, horizontal, angled, and transverse support members to provide for enhanced artistic and design feature appeal. Grills, lights (both headlamps, tail-lights, running lights, interior lighting, and other lights), dashboard features (including, but not limited to "speedometer" and other gauges, radio, vents, steering wheel, gearshift), and other standard interior automotive fixtures. Jack-stands and other automotive or garage elements and features can be added as optional accessories to the bed assembly to provide more realistic appearance.
2) Modified body styles such as Pick-up Truck, Hatchback, SUV, sedan, sports car, and other conventional and non-conventional body styles in order to replicate the current and any future body styles chosen by monster truck enthusiasts, drivers, clubs, companies, and the like.
3) Additional frame support members to provide structure and enhance the interior and exterior look, and necessary structural support, in conjunction with the variety of body styles mentioned in 2) above.
4) A choice of rim/wheel alternatives for those loyal to brand categories (yet to be licensed by appropriate companies). Such wheel alternatives could include large tread tires (such as those in monster truck racing), smooth wheels (to replicate street car slicks), or other styles that are similar to current and/or future tread designs of real tires.
5) Stickers and other branding items that provide artistic features such as automotive and garage elements or features.

BRIEF DESCRIPTION OF THE DRAWINGS

An improved and new utilization, lay-out, and design of rigid and flexible members to comprise the present invention are depicted in the accompanying drawings which help to describe the invention as part of this disclosure.

DESCRIPTION OF THE PREFERRED EMBODIMENT

Figure 1:
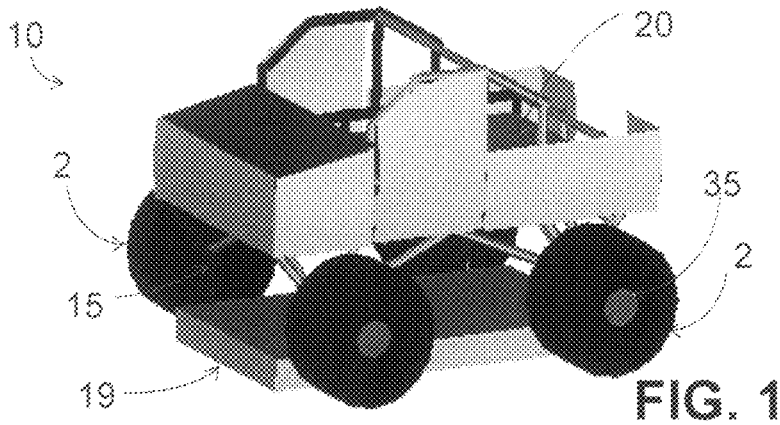
FIG. 1. is a front transverse view of the bed assembly of the present invention when fully assembled.

Referring to the figures for better understanding the present invention, a new bed assembly described and depicted by the figures generally designated by the reference numeral 10 is hereby described that embodies a combination of novel elements to provide an improved bed assembly which is both functional, ornamental, and entertaining. While the proposed drawings depict the overall scope and spirit of the present invention, the final orientation, angle, and dimensions of each part may be off-set, modified, or changed to allow for efficient manufacturing, to ensure adequate structural support, connections, and to meet the needed tolerances for joining adjacent parts. Body parts and pieces may also be adjusted in quantity, position, size, orientation, and material type for enhancing the safety of the finished product.

As illustrated in FIGS. 1-11, the bed assembly 10 of the present invention is one that is easily assembled and has a distinct appearance and functionality for people of all ages.

Figure 9:
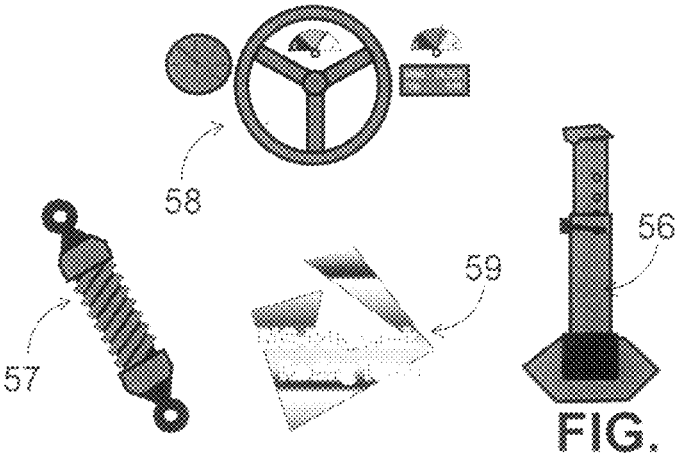
FIG. 9 is a view of some optional up-sale features for said present invention that would be common in automotive and garage businesses such as shocks, dashboard items, stickers/branding elements, and jack stand.

The appearance of the bed assembly in FIGS. 1, 3, 5 and 6, display the uniqueness of the present invention 10. The bed assembly generally comprises three parts shown in the following drawings: looking to FIG. 2, a frame 15; looking to FIG. 7, a body 1, and looking to FIG. 6, four wheels 2. Some optional features are also shown in FIG. 9 discussed later.

Returning to FIG. 1, the location of two mattresses for sleeping is observed at lower location 19, and upper location 20. The rim/wheels 2 are also visible. The frame 15 is visible under the body of the invention.

From FIG. 1, the rim/wheel assembly 2 is attached to the frame 15. An individual can remove the rim/wheel assembly 2 by detaching it from the frame 15. This is for entertainment and seating purposes, but by doing so, one does not lose the functionality of the invention as a bed due to the structural support members 17*a*, 17*b*, 18*a*, 18*b*, shown in FIG. 2.

Figure 2:
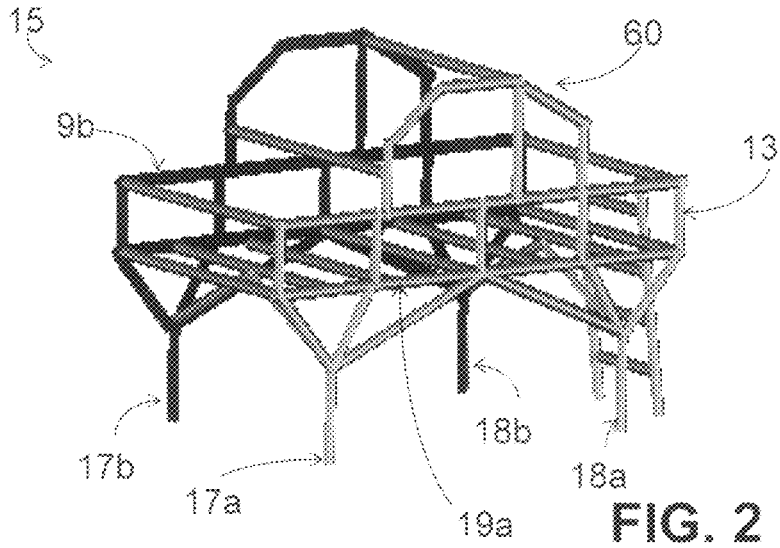
FIG. 2. is a front transverse view of the bed assembly of the present invention with the wheels and body detached.

From FIG. 2, vertical support members 17*a*, 17*b*, 18*a*, 18*b* provide structural integrity to the bed and support the weight of the frame assembly 15 even when the rim/wheel assembly 2 (from FIG. 1) is removed. Still looking at FIG. 2, the structural support members 17*a*, 17*b*, 18*a*, 18*b* can be covered with optional accessories shown in FIG. 9 such as jack stands 56 to give the appearance of real functionality of a jack stand when the rim and wheel assembly 2 (FIG. 1) are removed. Also visible in FIG. 2, are the vertical members 13 that hold the mattress from moving sideways. Horizontal members 19*a*, 9*b*, can also be seen which help to support the weight of the upper mattress (complementary members 19*b*, and 9*a* on opposing sides of frame are better visible in FIG. 4.). Various other structural support members 60 for the door and the roll cage members can also be seen.

Figure 3:
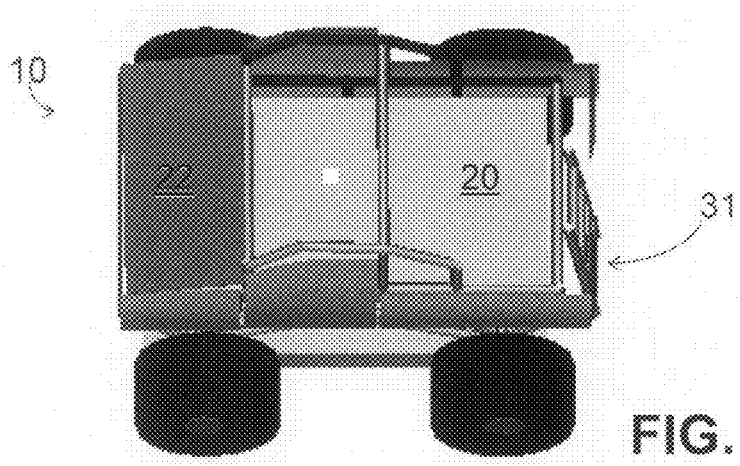
FIG. 3. is a top perspective view of the bed assembly of the present invention when fully assembled.

Moving to FIG. 3, the upper mattress 20 is visible and is accessed by the consumer by the ladder 31. Actual number of cross rails and attachment mechanism(s) for ladder 31 may vary during manufacturing to ensure safety of consumer. The hood 22 in closed position can be seen in this view.

Figure 4:
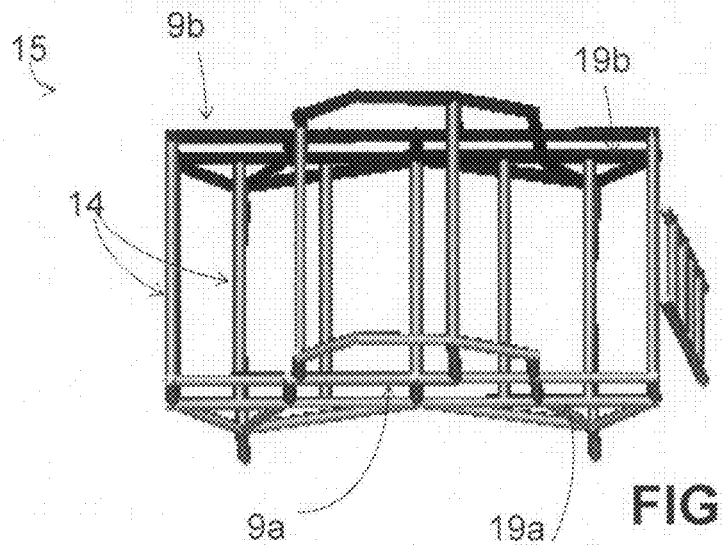
FIG. 4. is a top perspective view of the bed assembly of the present invention with the wheels and body detached.

Looking to FIG. 4, one can better see the support structure for the upper mattress location in members 9*a*, 9*b*, 19*a*, 19*b*, and transverse members 14. Due to structural requirements to support the load of a mattress and person, the number of transverse members 14 may be adjusted during final design and manufacturing.

Figure 5:
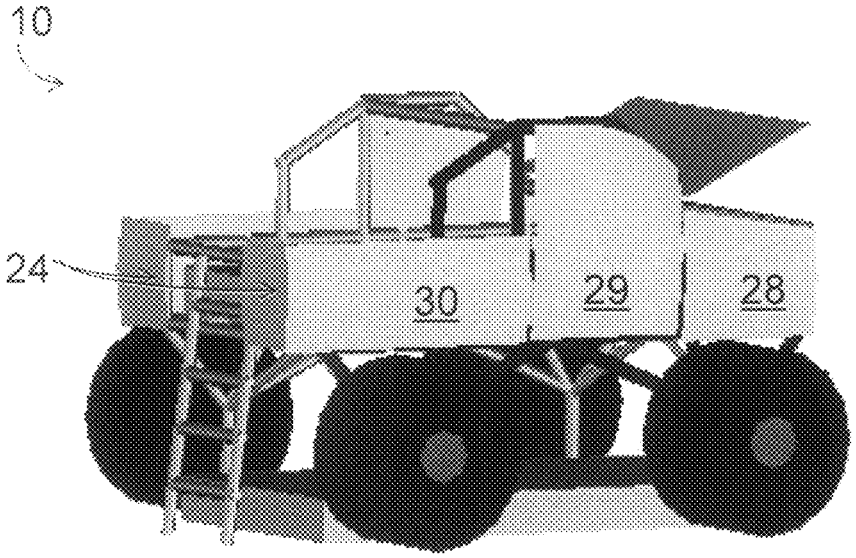
FIG. 5. is a rear perspective view of the bed assembly of the present invention when fully assembled.

Looking to FIG. 5, the right side body panels including right fender 28, right door 29, and right bed 30, as well as tailgate 24 can be seen.

Figure 6:
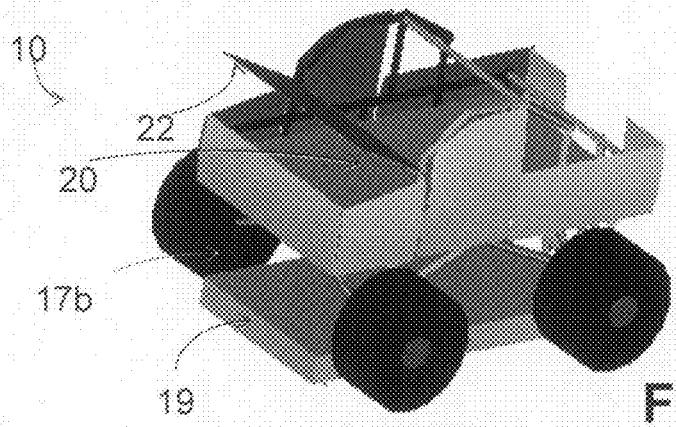
FIG. 6. is a perspective view of the bed assembly of the present invention when fully assembled with the hood open.

The location of two sleeping mattresses 19, 20 can be clearly seen in FIG. 6. It is NOT necessary to have a mattress in location 19, to utilize the invention as a single, elevated bunk at location 20. The purpose for two (2) locations is two-fold. The first function of the mattress near the floor 19 is to provide a location that is not as elevated as position 20. The lower position 19 can be utilized by children of younger ages to provide a location closer to the floor that is easily accessible and does not require climbing a ladder or steps. Position 20 is available for older children and provides for storage of a second mattress to utilize the bed assembly as a bunk bed. A mattress in either position 19 or position 20 provides a location for one (1) individual to sleep. Utilizing both positions 19 and 20 provides places for two (2) children to sleep.

Staying on FIG. 6, the hood 22 in raised position for access to upper mattress 20 can also be seen. One vertical support member 17*b* that supports the frame when a rim/wheel is removed can be seen in this view.

Figure 7:
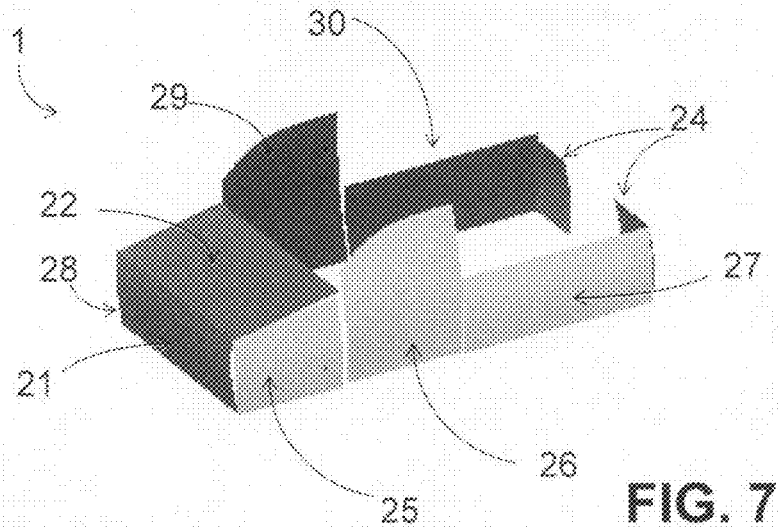
FIG. 7. is a perspective view of the bed assembly of the present invention's body, with frame and wheels removed.

In FIG. 7, the body 1 can be seen as comprised of multiple elements of a structure that can be seen as the following individual proposed elements: a front grill 21, hood 22, tailgate 24, left fender 25, left door 26, left bed 27, right fender 28 (FIG. 5), right door 29, right bed 30. In final production, the actual body elements comprising the total body 1, may be adjusted in number, for size, dimension, orientation, and material.

Figure 8:
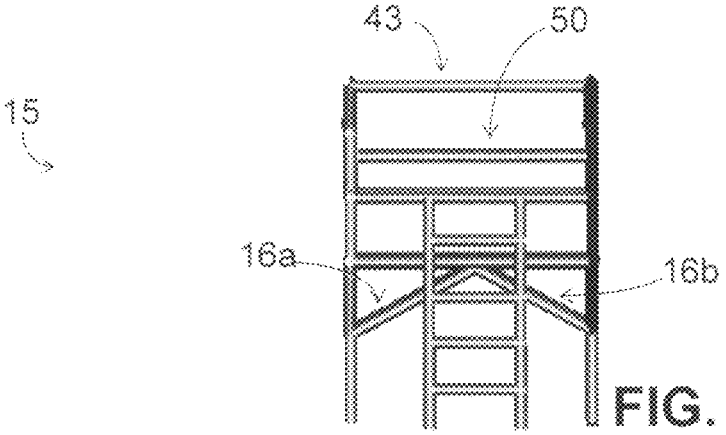
FIG. 8. is a rear view of the bed assembly of the present invention with the wheels and body removed.

Looking from the rear now in FIG. 8, the bed frame assembly can be seen with structural support and transverse members 16*a*, 16*b*. Also viewable in FIG. 8, are cross members 43 for the roll bar support, as well as hood hinge structural member 50.

Some optional features are shown in FIG. 9 including jack stands 56, shocks 57, dashboard and dashboard items 58, and stickers and branding logos 59.

Figure 10:
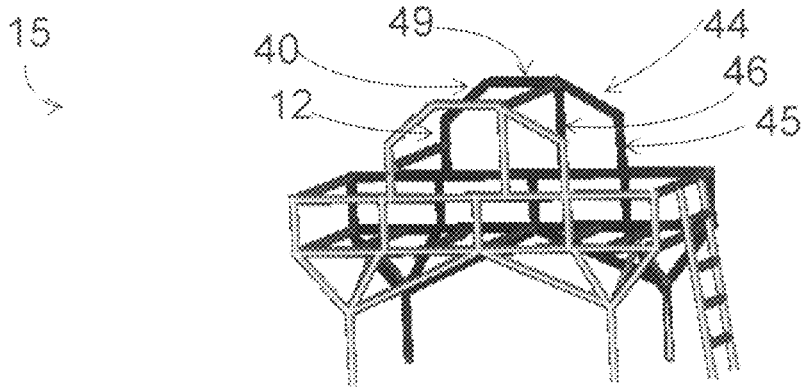
FIG. 10. is a perspective view of the bed assembly of the present invention with the wheels and body detached.

FIG. 10, shows a better transverse view of the support members on the right/passenger side including door and roll cage support members 12, 40, 44, 45, 46, 49.

Figure 11:
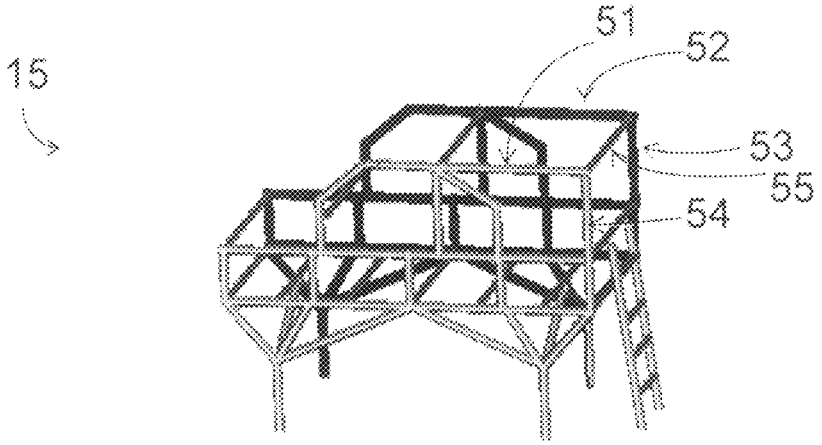
FIG. 11. is a perspective view of the bed assembly of the present invention with the wheels and body detached, showing some optional structural frame members to support varied body styles.

In FIG. 11, optional support members 51, 52, 53, 54, 55 are added to the frame 15 to support varying body styles or types.

Considering all of these descriptions, it must be recalled that these are conceptual and pre-manufactured images and concepts. The actual realized dimensions, quantity, and placement of all members, especially those for structural support, may be relocated to allow for ease of manufacture and to ensure the safety of the user(s). Accordingly, any and all modifications to these descriptions are considered to fall within the scope of the invention.

What is claimed is:

1. A bed assembly, comprising:

an assembly for providing a place of entertainment and a place to sleep and that mimics a vehicle, the assembly comprising:

a frame that supports a mattress, a plurality of body panels, and a plurality of wheels, the frame further comprising:

four vertical members each having a top end and a bottom end;

each top end of the vertical members being attached to at least one angled member such that the angled members are disposed above the vertical members;

each angled member having a top end and a bottom end, wherein the top ends of the angled members are spaced apart from each other and are substantially coplanar;

and a plurality of horizontal members attached to the top ends of the angled members to support the mattress, wherein the horizontal members are disposed above the angled members and are substantially coplanar;

wherein each of the plurality of body panels ace include a top edge which is selectively attachable to and detachable from the horizontal members, such that the plurality of body panels extend substantially vertically from the horizontal members, and do not affect the functionality or stability of the bed assembly when removed;

and wherein each of the wheels include a center region which is selectively attachable to and detachable from respective areas of attachment between the vertical members and angled members, such that the wheels extend substantially from the bottom ends of the vertical members to the top ends of the angled members and do not affect the functionality or stability of the bed when removed.

2. A bed assembly as described in claim 1 wherein:

the plurality of body panels give shape and dimension to the frame.

3. A bed assembly as described in claim 1 further comprising:

optional items attachable to the frame including up-sale accessories for ornamental design and entertainment purposes such as, but are not limited to shocks, grills, lights, dashboard features, other automotive and garage elements or features, such as jack-stands, as well as stickers and logos to represent and give the appearance of branding.

4. A bed assembly as described in claim 1 further comprising optional support members attachable to the frame to support varied body styling.

5. A bed assembly as described in claim 1 further comprising:

removable wheels comprising tire and rim assemblies;

wherein the body panels give shape and dimension to the frame and are interchangeable for a variety of designs;

wherein any or all wheels are configured to be removed without jeopardizing the safety of said bed assembly;

the wheels and the tire and rim assemblies are easily detachable and attachable to the vertical members;

the wheels and the tire and rim assemblies are made to represent the large tires that are commonly used on monster trucks;

and further comprise wheels of a differing variety, such as branded with logos, or with differing tread patterns and blocks based on consumer choice, and body styling, wheels that are interchangeable and can be easily detached and attached to the vertical members;

and wheels that may be used for seating;

optional items attachable to the frame including up-sale accessories for ornamental design and entertainment purposes such as, but are not limited to shocks, grills, lights, dashboard features, other automotive and garage elements or features, such as jack-stands, as well as stickers and logos to represent and give the appearance of branding and to support varied body styling.

6. A bed assembly comprising:

an assembly that is functional, ornamental, and entertaining and that comprises an independent frame, body panels, and wheels;

the frame further comprising:

four vertical members each having a top end and a bottom end;

each top end of the vertical members being attached to at least one angled member such that the angled members are disposed above the vertical members;

each angled member having a top end and a bottom end, wherein the top ends of the angled members are spaced apart from each other and are substantially coplanar;

and a plurality of horizontal members attached to the top ends of the angled members to support the mattress, wherein the horizontal members are disposed above the angled members and are substantially coplanar;

wherein the plurality of body panels and the wheels are selectively attachable to and detachable from the vertical members, the angled members, and the horizontal members of the frame such that the assembly resembles a vehicle; and wherein each of the wheels include a center region which is selectively attachable to and detachable from respective areas of attachment between the vertical members and angled members, such that the wheels extend substantially from the bottom ends of the vertical members to the top ends of the angled members and do not affect the functionality or stability of the bed when removed.

7. A bed assembly as described in claim 6 wherein:

the body panels comprise an ornamental design;

the body panels attach independently from one another to the frame and are removable and exchangeable for other design shapes and patterns.

8. A bed assembly as described in claim 6 wherein:

the body panels are easily interchangeable for a variety of designs.

9. A bed assembly as described in claim 6 wherein any or all of the wheels are configured to be removed without jeopardizing the safety of said bed assembly.

10. A bed assembly comprising:

an assembly that is functional, ornamental, and entertaining and that comprises a frame, body panels, and wheels comprising tire and rim assemblies;

the frame further comprising:

four vertical members each having a top end and a bottom end;

each top end of the vertical members being attached to at least one angled member such that the angled members are disposed above the vertical members;

each angled member having a top end and a bottom end, wherein the top ends of the angled members are spaced apart from each other and are substantially coplanar;

and a plurality of horizontal members attached to the top ends of the angled members to support the mattress, wherein the horizontal members are disposed above the angled members and are substantially coplanar;

wherein the body panels and the wheels are selectively attachable to and detachable from the vertical members, the angled members, and the horizontal members of the frame such that the assembly resembles a vehicle; and wherein each of the wheels include a center region which is selectively attachable to and detachable from respective areas of attachment between the vertical members and angled members, such that the wheels extend substantially from the bottom ends of the vertical members to the top ends of the angled members and do not affect the functionality or stability of the bed when removed.

11. A bed assembly as described in claim 10 wherein said wheels and said tire and rim assemblies are easily detachable and attachable to the vertical members.

12. A bed assembly as described in claim 10 wherein said wheels and the tire and rim assemblies are made to represent large tires that are commonly used on monster trucks;

and further comprise wheels of a differing variety, such as branded with logos, or with differing tread patterns and blocks based on consumer choice, and body styling;

wheels that are interchangeable and can be easily detached and attached to the vertical members and wheels that may be used for seating.

* * * * *